US006419592B1

(12) United States Patent
Player

(10) Patent No.: US 6,419,592 B1
(45) Date of Patent: Jul. 16, 2002

(54) GOLF CLUB HANDLE MOISTURE PROTECTION DEVICE

(76) Inventor: James E. Player, 3945 Cliftondale Pl., College Park, GA (US) 30349

( * ) Notice: Subject to any disclaimer, the term of this patent is extended or adjusted under 35 U.S.C. 154(b) by 0 days.

(21) Appl. No.: 09/736,700

(22) Filed: Dec. 15, 2000

(51) Int. Cl.[7] ..... A63B 55/10

(52) U.S. Cl. ..... 473/282; 211/70.2; 248/520; 248/530; 248/688

(58) Field of Search ..... 473/282; 248/520, 248/156, 688, 511, 530, 121; 211/70.2, 70.8; D27/796; D6/552; 43/21.2

(56) References Cited

U.S. PATENT DOCUMENTS 3,385,544 A * 5/1968 Barnett
D245,214 S * 8/1977 Allen
4,938,446 A * 7/1990 Williams
D318,090 S * 7/1991 Bahns
D335,994 S * 6/1993 Cude
5,285,990 A * 2/1994 Engel
D365,717 S * 1/1996 Cardenas
5,557,877 A * 9/1996 Colson
5,636,754 A * 6/1997 Ennis
5,823,360 A 10/1998 Gorosave
5,873,471 A 2/1999 Ruggeri
D406,960 S * 3/1999 Zaid
D407,774 S * 4/1999 Weiss
D410,270 S * 5/1999 Summers
5,947,583 A 9/1999 Castano
6,213,314 B1 4/2001 Beemer
D447,530 S * 9/2001 Hidalgo

* cited by examiner

*Primary Examiner*—Stephen Blau

(57) ABSTRACT

A receptacle device for propping and supporting, above ground, the elevated golf club grip handle of a grounded golf club, preventing the golf club grip handle from coming in contact with ground surface moisture.

8 Claims, 5 Drawing Sheets

GOLF CLUB HANDLE MOISTURE PROTECTION DEVICE

BACKGROUND OF THE INVENTION:

This invention pertains to golf clubs, used in the game of golf, in a manner as to prevent the golf club grip handle from coming in contact with moisture on the ground and grass of the golf course.

Golf clubs, used by golfers, are manufactured using hard materials that do not absorb moisture. To complete the golf club, a grip handle is added to the golf club, insuring the golfer a tight, non slip, hand gripping surface.

Most golf club grip handles are manufactured from porous materials, and when wet, or moist, will allow the golf club to slip or slide in the hands of the golfer, resulting in off line club direction during the golfers swing.

While playing the game of golf, golfers have golf carts available for transporting the golfer, the golf clubs, and the golf bag, throughout the golf course.

Each golf hole, on every golf course, has designated "no cart" areas, approximately 30 to 50 yards, surrounding the putting greens, where golf carts are not allowed.

The biggest percent of golf balls hit to golf greens land short, on to the "no cart" protected grass and sand trap areas that surround the putting greens.

Walking into the "no cart" area, the golfer must hand carry several different golf clubs. As the golfer selects one club that will be used to play, the golfer will temporarily put aside the other golf clubs that are held. The golfer then will lay the extra golf clubs on the ground surface, which could transfer ground moisture to the golf club grip handle, or lay the golf club grip handles on a towel, rock, or on any other handy object, in attempting to prevent the golf club grip handle from coming in contract with ground surface moisture.

Towels, on the ground surface, will absorb moisture and in turn will transfer the moisture to the golf club grip handle.

Rocks or other items may not be available for use, and when available, may not prevent the grip handle from falling onto the ground surface.

OBJECT OF THE INVENTION

The object of the invention is to solve the golf club grip handle moisture difficulty of the prior art, providing an extremely simple, convenient and reliable devise that will prevent the golf club grip handle, of a grounded golf club, from coming in contact with the ground and grass areas on the golf course.

Another object of the invention is to provide a means to anchor the invention in the ground, for stabilization, or to provide a means of tripodal stabilization on any ground surface.

A further object of the invention is to make available hoops on the invention that will receive the fasteners of other golf items, such as towels, golf club cleaning brush, containers, or golf tees.

Another object of the invention is to provide hooks that will attach the invention on to all standard golf bags, for storing the invention in a golf bag, and will also attach the invention to the golfers belt, for transporting the invention.

Still another object of the invention is to provide a framed containment resting area that will prevent the golf club grip handle, of a grounded golf club, in elevation, from falling to the ground.

Other advantages and features of novelty will become apparent to those skilled in the prior art in following the description of the preferred form of the invention, illustrated in the accompanying drawings.

DETAILED DESCRIPTION OF THE DRAWINGS

Figure 1:
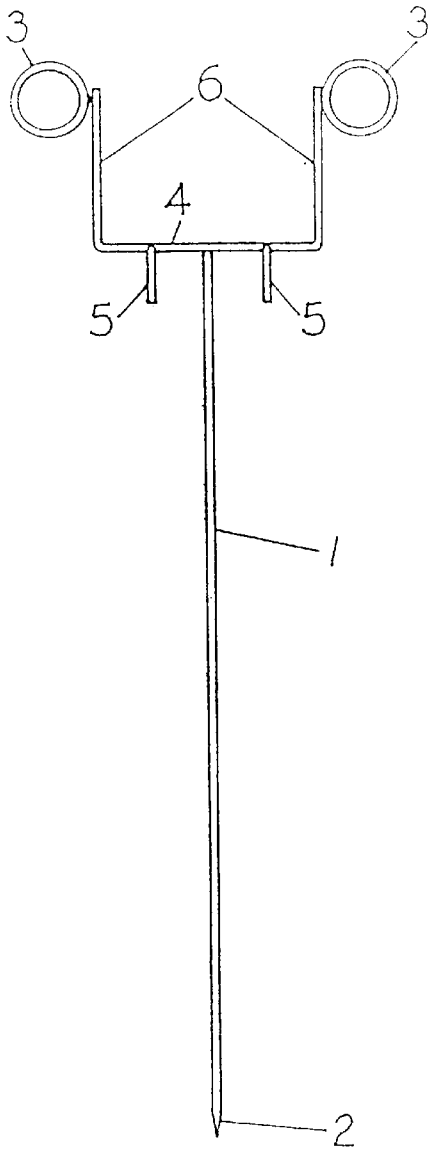
FIG. 1 is a front perspective view of a preferred form of the invention.
Figure 2:
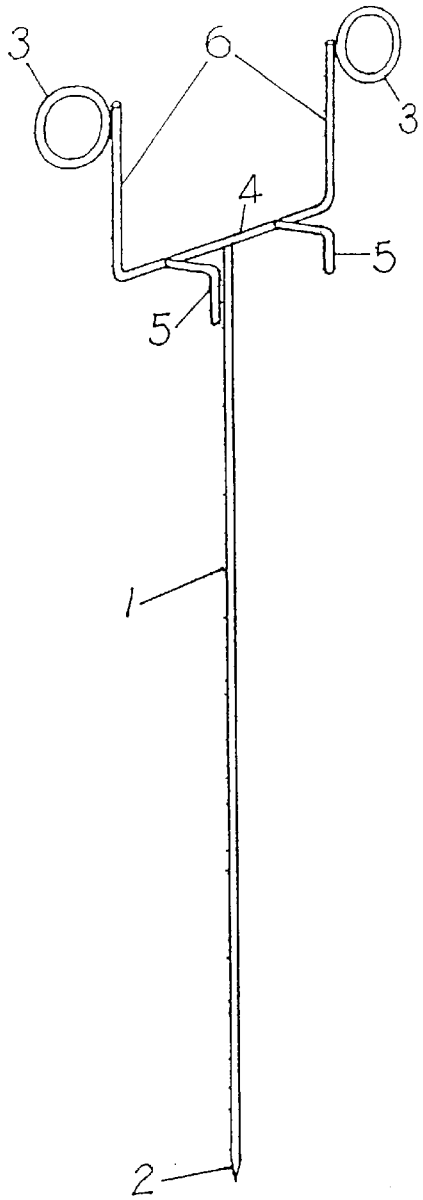
FIG. 2 is a rear angled perspective view of a preferred form of the invention.

Referring to the drawings in detail wherein like numerals designate like parts, and referring first to FIG. 1 and FIG. 2, a golf club grip handle moisture protection device, preferably formed of light weight materials such as certain types of metal, commercial plastic or the like, comprising the bottom base tapered end 2 of the stabilizing stake post 1, extending vertically upward, connected to the bottom of the base frame piece 4.

In FIG. 1 and FIG. 2, the invention further comprises two side frame pieces 6, spaced apart, open at the top, defining the golf club grip handle containment area, providing the passage way to nestle the golf club grip handle, of the grounded golf club, atop the base frame piece 4.

In FIG. 1 and FIG. 2, the invention further comprises hooks 5 balanced to support the invention vertically upright, in storage, or while transporting the invention.

Figure 3:
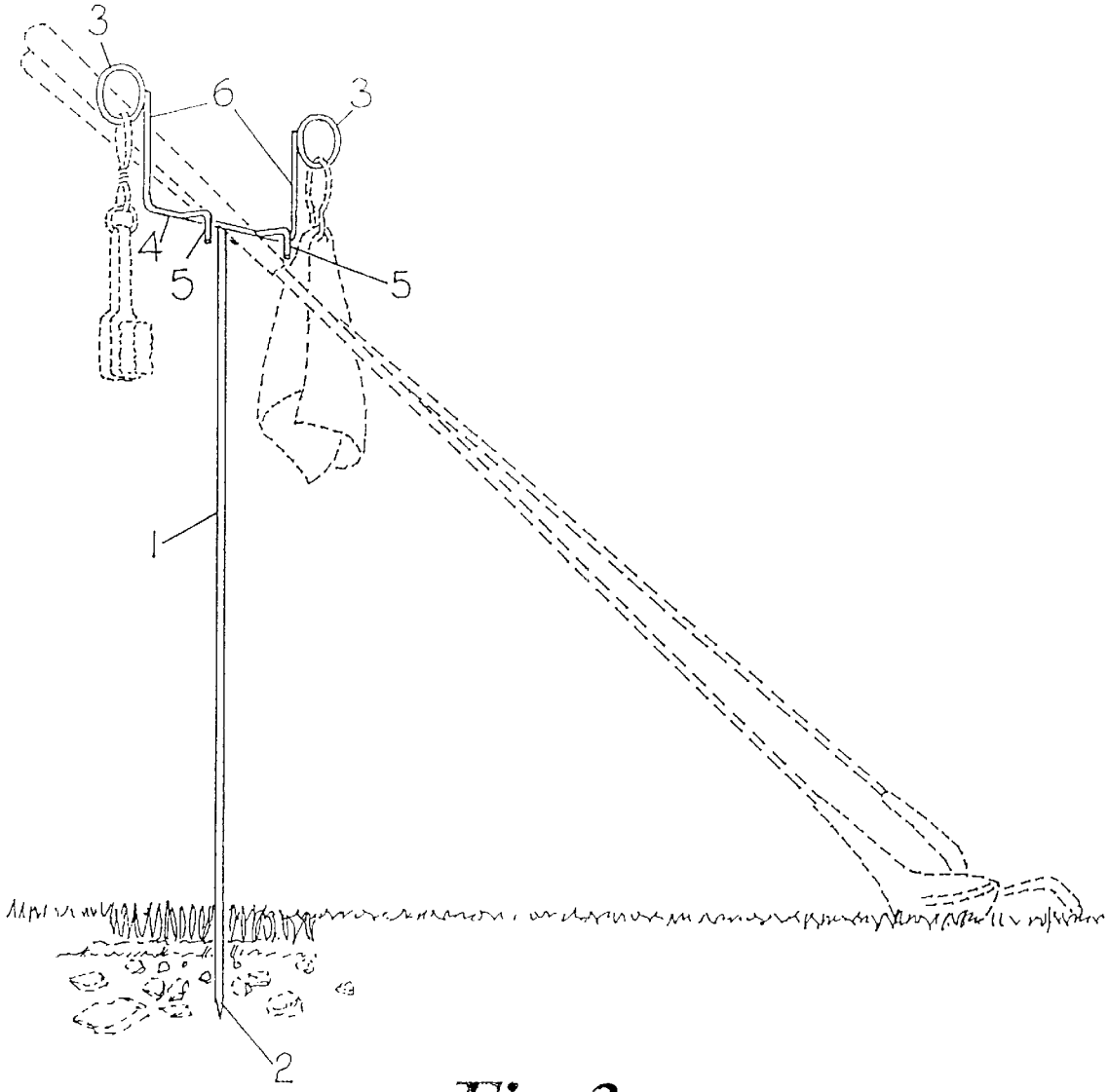
FIG. 3 is a perspective view depicting the operational function of the invention.

Referring to FIG. 3, a visual perspective depiction of the invention anchored in the ground, a result of manual downward pressure having been applied atop the base frame piece 4, thus driving the stake post 1 downward as the point end 2 penetrates the ground to a depth sufficient as to support the invention upright.

Also referring to FIG. 3, a visual perspective depiction of the invention, stabilized in anchor, supporting the elevated golf club grip handles of several grounded golf clubs, said grip handles resting atop the base frame piece 4.

Also referring to FIG. 3, a depiction of the hoops 3 on the invention engaged by fasteners of a golf club cleaning brush and a golf towel.

Figure 4:
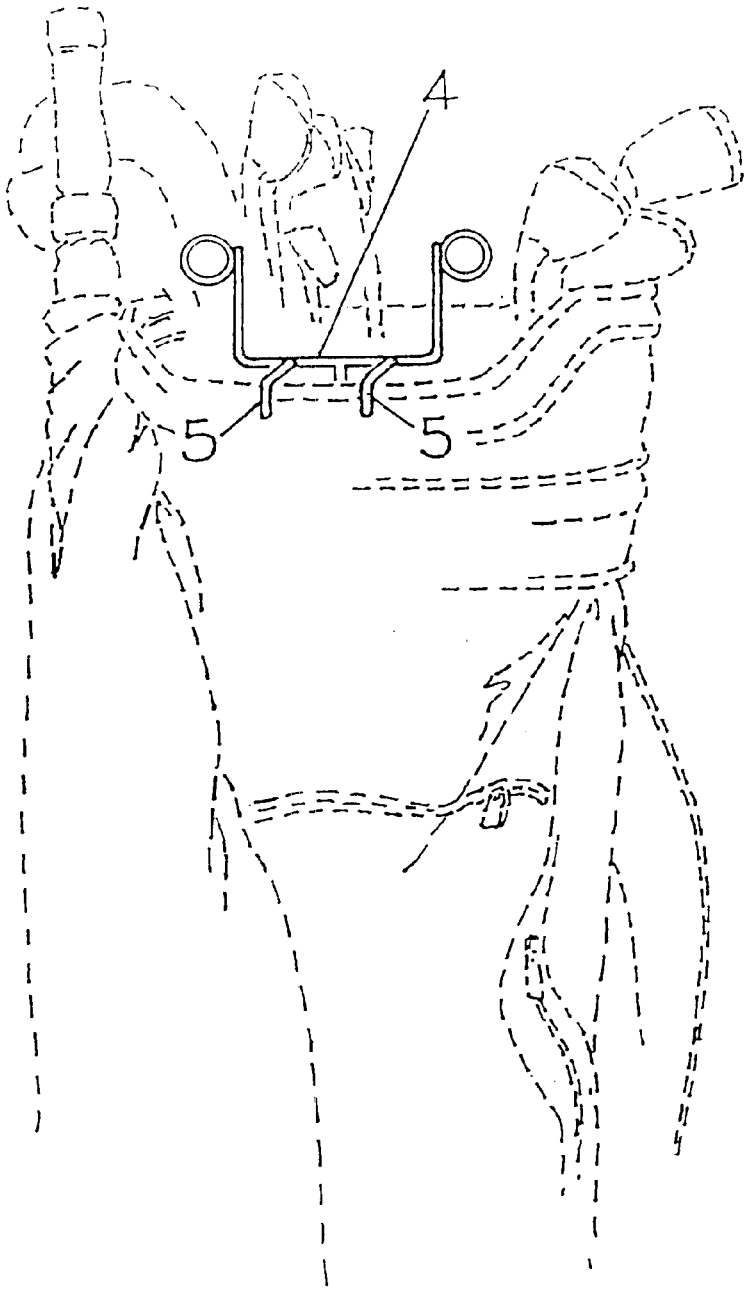
FIG. 4 is a perspective view featuring the invention in the preferred storage mode.

Referring to FIG. 4, a depiction of two hooks 5 in connection with the base frame piece 4, stabilizing the invention as it is stored, inside a golf bag.

Figure 5:
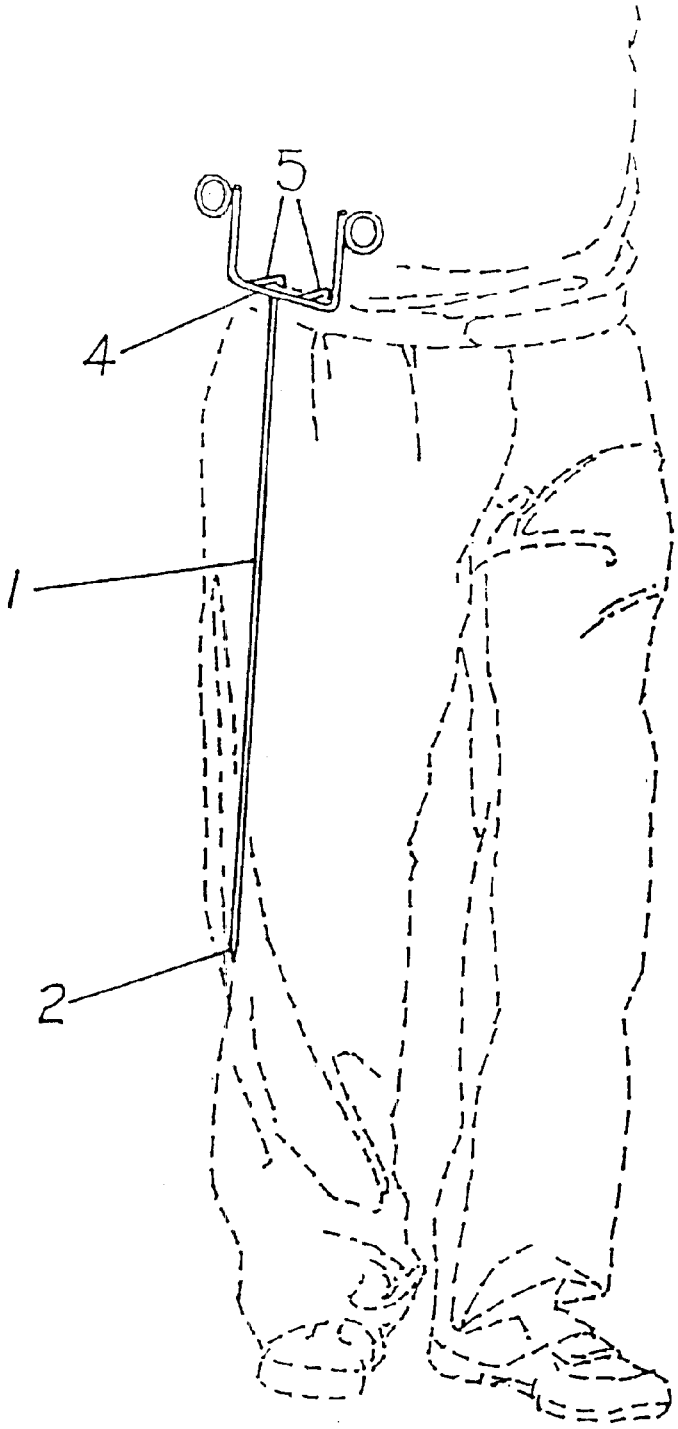
FIG. 5 is a perspective view featuring the invention in the preferred attached mode of transportation.

Referring to FIG. 5, a depiction of the invention in vertical stabilization as the hooks 5 attach to the golfers belt, in transportation mode.

Figure 6:
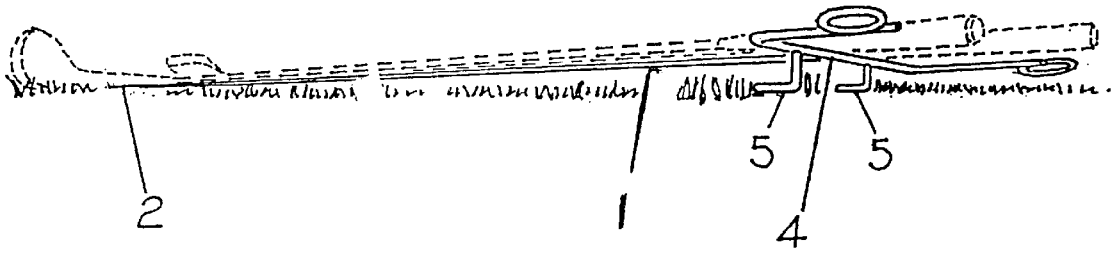
FIG. 6 is a perspective view depicting the invention in tripodal stabilization, on ground, with the golf club grip handles supported by the invention shielding the grip handles from the ground surface.

In referring to FIG. 6, a visual perspective depiction of the invention, wherein the outward most points of the hooks 5 are grounded in combination with the grounded point end 2 of the stake post stem 1, forming tripodal support to stabilize the frame base piece 4 above the ground surface, in a receiver mode, shielding and supporting the elevated golf club grip handle of a grounded golf club from the ground surface moisture.

It is to be understood the form of the invention herewith shown and described is to be taken as the preferred example, and that various changes in the shape, size and arrangement of parts may be resorted to, without departing from the spirit of the scope of the appended claims.

What I claim is:

1. A receptacle device, to receive and store therein, an elevated grip handle end of a grounded golf club, comprising a vertical stake post stem attached to a horizontal base frame piece, only two vertical side frame pieces with one vertical side frame piece attached to each end of said horizontal base frame piece, two hooks and two hoops wherein said hooks are attached directly to said horizontal base frame piece and one hoop is attached directly to an end of each vertical side frame piece.

2. A receptacle device as defined in claim 1, that will anchor and stabilize as manual downward pressure is applied atop the said frame base piece until the said stake post stem, point end, penetrates the ground to a sufficient depth required to support the device upright, in a "receptive mode".

3. A receptacle device as defined in claim 1, wherein the said two hooks extend horizontally outward a distance from the said base frame piece, to curve downward a distance.

4. A receptacle device as defined in claim 1, wherein the outward most points of the two said hooks, grounded, in combination with the grounded point end of the said stake post stem, form a tripodal support to elevate the said base frame piece, above ground, stabilized in a "receptive mode".

5. A receptacle device as defined in claim 1, wherein the apertures of the said hoops are large enough to accommodate the attachment devices of several secondary utility golf items.

6. A receptacle device as defined in claim 1, wherein the: two said side frames pieces in combination with the said base frame piece, open at a top, provide a passageway for the golf club grip handle to come to rest atop the said base frame piece as the elevated golf club is grounded.

7. A receptacle device as defined in claim 1, that will accommodate a multiplicity of golf club grip handles at the same time.

8. A receptacle device as defined in claim 1, wherein the two said hooks provide the means to attach the device on to any golf bag, for storing the device, or on to a golfer's pants belt, for transporting the device.

* * * * *